US006785968B1

(12) United States Patent
Stevens

(10) Patent No.: US 6,785,968 B1
(45) Date of Patent: Sep. 7, 2004

(54) FABRIC-CUTTING SCISSORS

(76) Inventor: Mary M. Stevens, 3118 N. Arlington Ave., Indianapolis, IN (US) 46218

( * ) Notice: Subject to any disclaimer, the term of this patent is extended or adjusted under 35 U.S.C. 154(b) by 0 days.

(21) Appl. No.: 10/188,505

(22) Filed: Jul. 5, 2002

(51) Int. Cl.[7] ..... B26B 13/10
(52) U.S. Cl. ..... 30/230; 30/254
(58) Field of Search ..... 30/229, 230, 254, 30/355; 28/57

(56) References Cited

U.S. PATENT DOCUMENTS 2,800,715 A * 7/1957 Cohen ..... 30/230
2,951,289 A * 9/1960 De Ferbrache et al. ..... 30/254
3,222,783 A * 12/1965 Kolts et al. ..... 30/230
3,325,897 A * 6/1967 Luebkeman ..... 30/254
4,250,619 A * 2/1981 Buerkert et al. ..... 30/230
4,584,770 A * 4/1986 Sabol ..... 30/230
4,930,219 A * 6/1990 Nadeau ..... 30/230
4,984,368 A * 1/1991 Hoover et al. ..... 30/254
5,421,090 A * 6/1995 Chiou ..... 30/254
5,758,422 A * 6/1998 Frank ..... 30/230
D451,354 S * 12/2001 Liu ..... D8/57

* cited by examiner

*Primary Examiner*—Hwei-Siu Payer

(57) ABSTRACT

A fabric-cutting scissors for cutting fabric and creating a finished edge. The fabric-cutting scissors includes a first elongate cutting member having a looped handle portion and a cutting portion having a rounded outer end; and also includes a second elongate cutting member having a looped handle portion and a cutting portion having a rounded outer end, and also having an intermediate portion being pivotally attached to an intermediate portion of the first elongate cutting member.

5 Claims, 3 Drawing Sheets

FABRIC-CUTTING SCISSORS

BACKGROUND OF THE INVENTION

1. Field of the Invention

The present invention relates to fabric cutters and more particularly pertains to a new fabric-cutting scissors for cutting fabric and creating a finished edge.

2. Description of the Prior Art

The use of fabric cutters is known in the prior art. More specifically, fabric cutters heretofore devised and utilized are known to consist basically of familiar, expected and obvious structural configurations, notwithstanding the myriad of designs encompassed by the crowded prior art which have been developed for the fulfillment of countless objectives and requirements.

The prior art describes inventions showing scissors having blade portions having teeth along longitudinal edges thereof for cutting objects. While these devices fulfill their respective, particular objectives and requirements, the aforementioned prior art do not disclose a new fabric-cutting scissors.

SUMMARY OF THE INVENTION

The general purpose of the present invention, which will be described subsequently in greater detail, is to provide a new fabric-cutting scissors which has many of the advantages of the fabric cutters mentioned heretofore and many novel features that result in a new fabric-cutting scissors which is not anticipated, rendered obvious, suggested, or even implied by any of the prior art fabric cutters, either alone or in any combination thereof. The present invention includes a first elongate cutting member having a looped handle portion and a cutting portion having a rounded outer end; and also includes a second elongate cutting member having a looped handle portion and a cutting portion having a rounded outer end, and also having an intermediate portion being pivotally attached to an intermediate portion of the first elongate cutting member. None of the prior art describes the bowlike recessed portion and the bowlike bulge portion of the present invention.

There has thus been outlined, rather broadly, the more important features of the fabric-cutting scissors in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new fabric-cutting scissors which has many of the advantages of the fabric cutters mentioned heretofore and many novel features that result in a new fabric-cutting scissors which is not anticipated, rendered obvious, suggested, or even implied by any of the prior art fabric cutters, either alone or in any combination thereof.

Still another object of the present invention is to provide a new fabric-cutting scissors for cutting fabric and creating a finished edge.

Still yet another object of the present invention is to provide a new fabric-cutting scissors that is easy and convenient to use.

Even still another object of the present invention is to provide a new fabric-cutting scissors that eliminates the user having to sew, then pin, and then trim to form the finished edge on the fabric.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
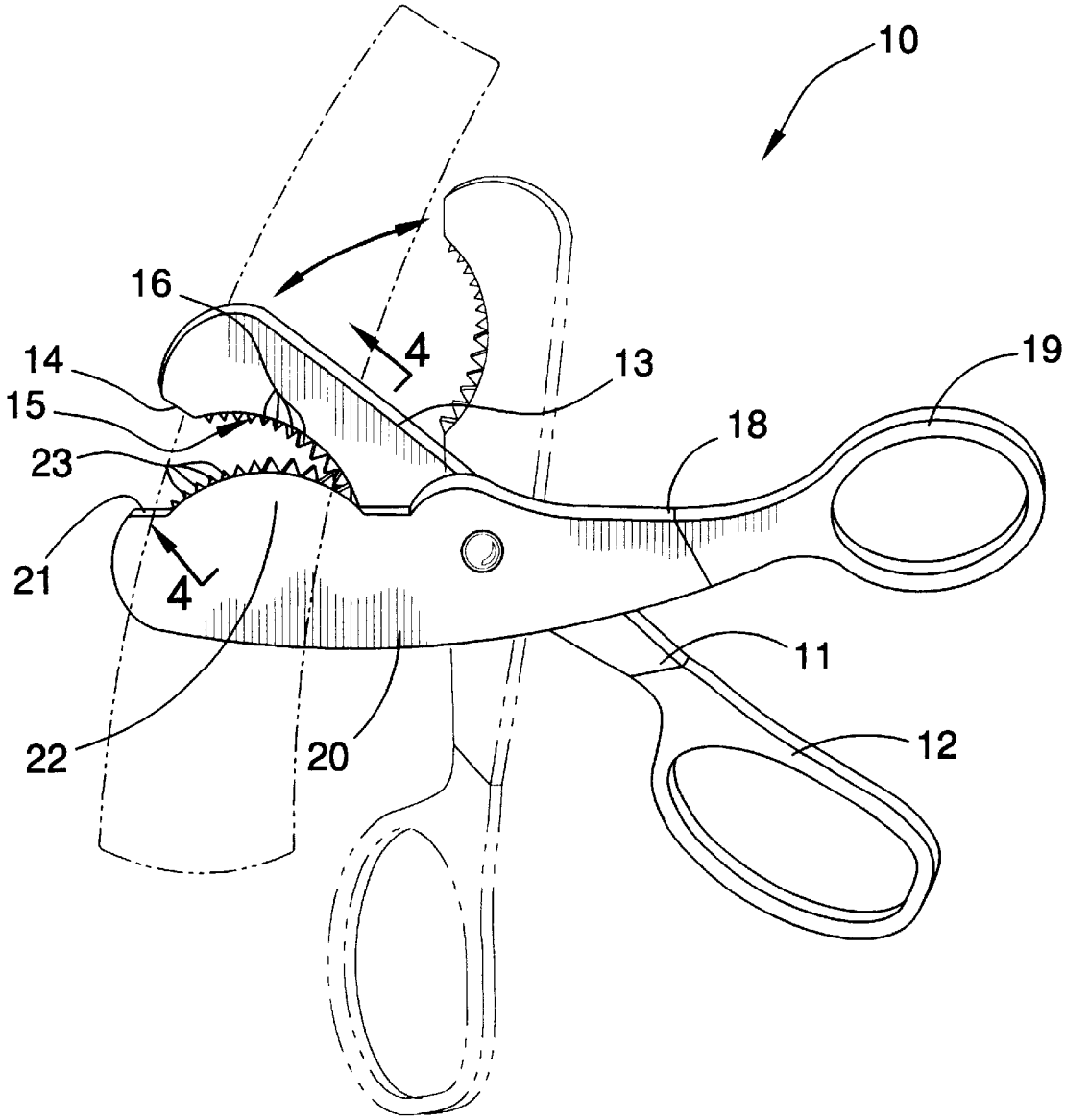
FIG. 1 is a perspective view of a new fabric-cutting scissors according to the present invention.
Figure 2:
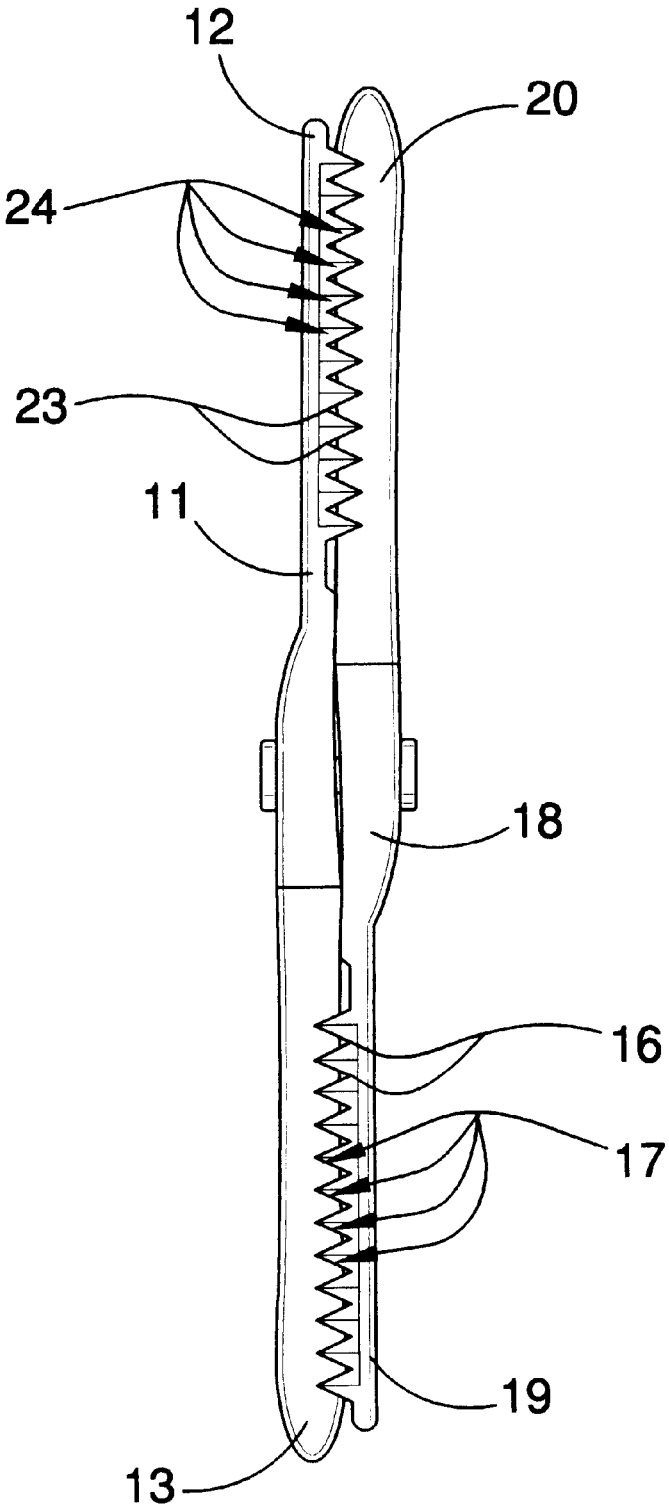
FIG. 2 is an outer end elevational view of the present invention.
Figure 3:
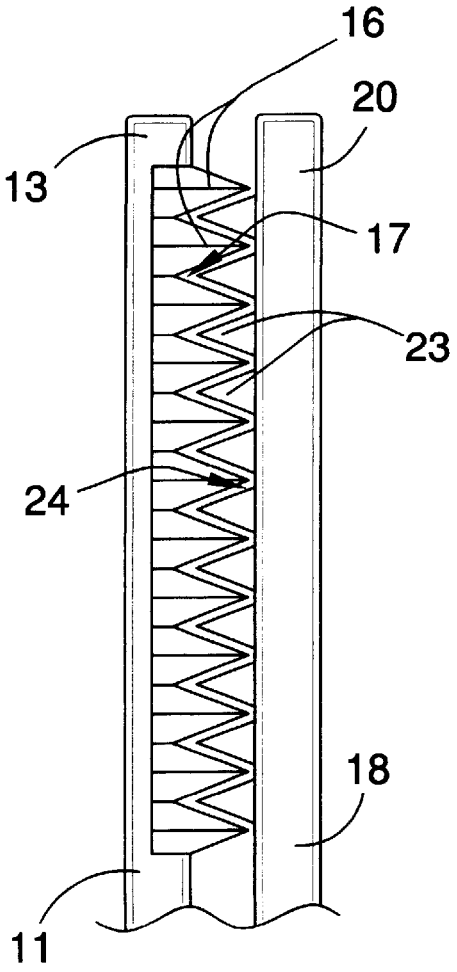
FIG. 3 is detailed outer end elevational view of the present invention.
Figure 4:
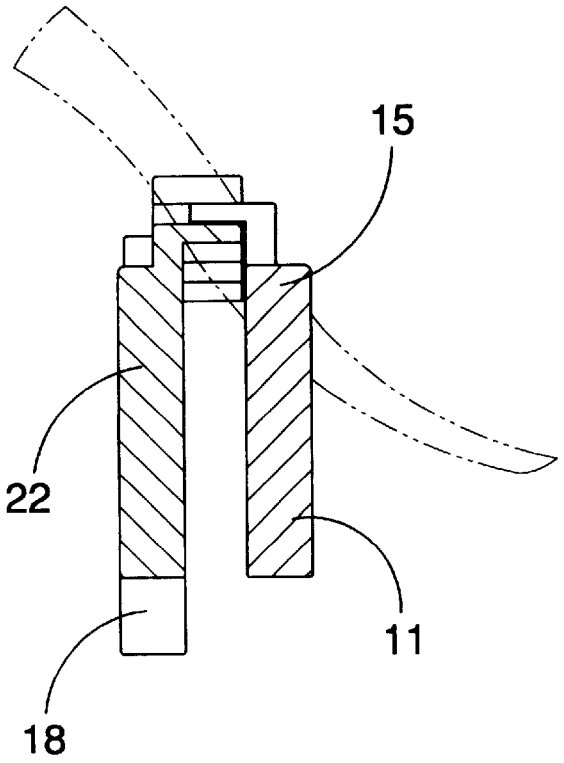

With reference now to the drawings, and in particular to FIGS. 1 through 3 thereof, a new fabric-cutting scissors embodying the principles and concepts of the present invention and generally designated by the reference numeral 10 will be described.

As best illustrated in FIGS. 1 through 3, the fabric-cutting scissors 10 generally comprises a first elongate cutting member 11 having a looped handle portion 12 and a cutting portion 13 having a rounded outer end. The first elongate cutting member 11 also has a bowlike recessed portion 15 being disposed along a length of and in a longitudinal edge 14 of the cutting portion 13 thereof. The first elongate cutting member 11 further has a plurality of teeth 16 being spacedly and conventionally disposed and arranged along the bowlike recessed portion 15 and forming wedge-shaped spaces 17 therebetween with the teeth 16 being extended generally perpendicular to a side of the first elongate cutting member 11.

A second elongate cutting member 18 has a looped handle portion 19 and a cutting portion 20 having a rounded outer end, and also having an intermediate portion being pivotally and conventionally attached with a fastener to an intermediate portion of the first elongate cutting member 11. The second elongate cutting member 18 also has a bowlike bulge 22 being disposed along a length of a longitudinal edge 21 of the cutting portion 20 thereof with the bowlike bulge 22 being generally opposed and juxtaposed to the bowlike recessed portion 15. The second elongate cutting member 18 further has a plurality of teeth 23 being spacedly and conventionally disposed and arranged along the bowlike bulge 22 and forming wedge-shaped spaces 24 therebetween with the teeth 23 being extended generally perpendicular to a side of the second elongate cutting member 18. The teeth 16 of the first elongate cutting member 11 are arranged to be removably received in the wedge-shaped spaces 24 of the second elongate cutting member 18, and the teeth 23 of the second elongate cutting member 18 are arranged to be removably received in the wedge-shaped spaces 17 of the first elongate cutting member 11, The teeth 16,23 of the first and second elongate cutting members 11,18 being arranged to intermesh with one another as the fabric-cutting scissors 10 cuts through fabric. The teeth 16,23 of the first and second elongate cutting members 11,18 are generally wedge-shaped and have pointed tips.

In use, the user pivots the cutting portions 13,20 apart and places the fabric therebetween and then pivots the cutting portions 13, 20 toward and away from one another with the teeth 16,23 cutting through the fabric and forming finished edges.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the fabric-cutting scissors. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fabric-cutting scissors comprising:

a first elongate cutting member having a looped handle portion and a cutting portion having a rounded outer end, said first elongate cutting member also having a bow-shaped recessed portion being disposed along a length of and in a longitudinal edge of said cutting portion thereof, said first elongate cutting member further having a plurality of teeth being spacedly disposed and arranged along said bow-shaped recessed portion and forming wedge-shaped spaces therebetween, said teeth being extended generally perpendicular to a side of said first elongate cutting member; and a second elongate cutting member having a looped handle portion and a cutting portion having a rounded outer end, and also having an intermediate portion being pivotally attached to an intermediate portion of said first elongate cutting member.

2. A fabric-cutting scissors as described in claim 1, wherein said second elongate cutting member also has a bow-shaped bulge being disposed along a length of a longitudinal edge of said cutting portion thereof, said bow-shaped bulge being generally opposed and juxtaposed to said bow-shaped recessed portion.

3. A fabric-cutting scissors as described in claim 2, wherein said second elongate cutting member further has a plurality of teeth being spacedly disposed and arranged along said bow-shaped bulge and forming wedge-shaped spaces therebetween, said teeth of said second elongate cutting member being extended generally perpendicular to a side of said second elongate cutting member.

4. A fabric-cutting scissors as described in claim 3, wherein said teeth of said first elongate cutting member are arranged to be removably received in said wedge-shaped spaces of said second elongate cutting member, and said teeth of said second elongate cutting member are arranged to be removably received in said wedge-shaped spaces of said first elongate cutting member, said teeth of said first and second elongate cutting members being arranged to intermesh with one another as said fabric-cutting scissors cuts through fabric.

5. A fabric-cutting scissors as described in claim 4, wherein said teeth of said first and second elongate cutting members are generally wedge-shaped and have pointed tips.

* * * * *